United States Patent [19]

Bissinger

[11] Patent Number: 4,734,175

[45] Date of Patent: Mar. 29, 1988

[54] PROCESS FOR REGENERATING AN ELECTROLESS COPPER PLATING BATH

[75] Inventor: Werner D. Bissinger, Sindelfingen, Fed. Rep. of Germany

[73] Assignee: International Business Machines Corporation, Armonk, N.Y.

[21] Appl. No.: 33,387

[22] Filed: Apr. 2, 1987

[30] Foreign Application Priority Data

Apr. 11, 1986 [EP] European Pat. Off. ..... 86105002.9

[51] Int. Cl.[4] ..... C25F 5/00

[52] U.S. Cl. ..... 204/130; 204/106

[58] Field of Search ..... 204/130, 106–108, 204/275–276, 232, 237, 238

[56] References Cited

U.S. PATENT DOCUMENTS

| | | | |
|---|---|---|---|
| 3,844,799 | 10/1974 | Underkofler | 106/1 |
| 4,144,149 | 3/1979 | Bollhalder | 204/149 |
| 4,302,319 | 11/1981 | Ueno | 204/238 |
| 4,324,629 | 4/1982 | Oka et al. | 204/130 |
| 4,425,205 | 1/1984 | Honma et al. | 204/151 |
| 4,545,877 | 10/1985 | Hillis | 204/237 |
| 4,549,946 | 10/1985 | Horn | 204/130 |

*Primary Examiner*—R. L. Andrews

*Attorney, Agent, or Firm*—Jeffrey S. LaBaw; Manny W. Schecter; Mark Levy

[57] ABSTRACT

A process and an apparatus are described for regenerating an electroless copper plating bath containing a complexing agent, preferably ethylenediamine tetraacetic acid. From the bath solution to be regenerated, the copper content is reduced by electrolysis to a value below 20 mg/l and the complexing agent subsequently precipitated by acidification and recovered. After dissolution in an alkaline electrolytic solution, the solution thus obtained is fed back to the electroless copper plating bath. A particularly pure ethylenediamine tetraacetic acid free from by-products is obtained if the pH value is kept constant during electrolysis, an anodic current density $i_+$ of 100 A/m$^2$ is not exceeded, and the anodic current density during electrolysis is reduced according to the electrolysis characteristic or in steps.

15 Claims, 7 Drawing Figures

DECOMPOSITION PRODUCT I

AMINES II a b c d e

FURTHER PRODUCTS III f g

PROCESS FOR REGENERATING AN ELECTROLESS COPPER PLATING BATH

BACKGROUND OF THE INVENTION

1. Field of the Invention

The invention concerns a process for regenerating an electroless copper plating bath containing a complexing agent, such as ethylenediamine tetraacetic acid or the like. The invention also concerns apparatus for implementing that process.

2. Description of the Related Art

Chemical copper plating baths, i.e., copper plating baths operating without connection to an external current source, are used, for instance, to coat plastic surfaces, to uniformly coat components of complex geometry, in particular to produce printed circuits by the semiadditive or the fully additive method. A feature in common to all chemical baths is that the stock of metal used for coating has to be introduced into the bath in a dissolved form. However, to obtain a passable deposition, the concentration of free metal has to be greatly limited. For that purpose, complexing agents are used which mask the metal cation and which, to maintain complexation equilibrium, release the metal cation in small quantities for the coating reaction. To limit the concentration of free metal cations as necessary, complexing agents are often added to the bath in quantities which are several times higher than those actually required. Ethylenediamine tetraacetic acid (EDTA) is most frequently used as a complexing agent.

To ensure that the copper film deposited by the electroless process has excellent physical properties, compared with electrolessly deposited films produced by the subtractive method that merely serve as a conductive thin film for a throughhole and on which copper is electrolytically deposited, it is essential that the composition of the electroless copper plating bath be controlled as accurately as possible so that its concentration is highly uniform and the formation of by-products is minimized. The latter is particularly essential in conjunction with the recovery of the complexing agent, preferably of the ethylenediamine tetraacetic acid existing in the electroless copper plating bath in high concentrations.

According to one known process, the copper plating bath containing the complexing agent is taken from the plating tank in full or in part, the copper content of the bath is reduced by precipitating the copper as metal copper or copper oxide or by using electrolysis, and by subsequently precipitating the complexing agent by acidification. The complexing agent thus recovered is returned to the anodic portion of a cell comprising a copper anode separated by an ion exchange membrane from the cathodic portion comprising the cathode. Then, DC current is applied to both electrodes, and the solution is fed back from the anodic portion of the cell to the electroless copper plating bath. In conjunction with this process, the effect of the conditions of electrolysis for reducing the copper content and how such conditions would influence the purity of the recovered complexing agent, preferably the EDTA, is unknown.

In a known process for decontaminating chemical plating baths, a heavy metal is removed from solution by selectively operating ion exchangers and the residual solution containing the complexing agent is processed further. However, this process is only suitable for separating metals from solutions containing complexing agents, the stability constant of which is less than that of the exchange resin. This does not apply to EDTA.

SUMMARY OF THE INVENTION

In view of the foregoing, it is the principal object of this invention to improve processes for regenerating electroless copper plating baths.

Another object of this invention is to regenerate electroless copper plating baths wherein the copper content of the bath is reduced by electrolysis and the conditions for its implementation are chosen such that when the residual solution containing the complexing agent is processed further, a very pure complexing agent, in particular a very pure ethylenediamine tetraacetic acid free from by-products, is obtained.

Still another object of this invention is to improve apparatus for implementing the aforementioned processes.

These and other objects of this invention are accomplished by reducing the copper content by electrolysis to a value below 20 mg/l and subsequently precipitating the complexing agent by acidification and recovering it. After dissolution in an alkaline electrolytic solution, the solution thus obtained is fed back to the electroless copper plating bath. The process is preferably used to regenerate ethylenediamine tetraacetic acid. A particularly pure ethylenediamine tetraacetic acid free from by-products is obtained if the pH value is kept constant during the electrolysis, an anodic current density $i_+$ of 100 $A/m^2$ is not exceeded, and the anodic current density during the electrolysis is reduced according to the electrolysis characteristic or in steps.

DESCRIPTION OF THE PREFERRED EMBODIMENT

Figure 1:
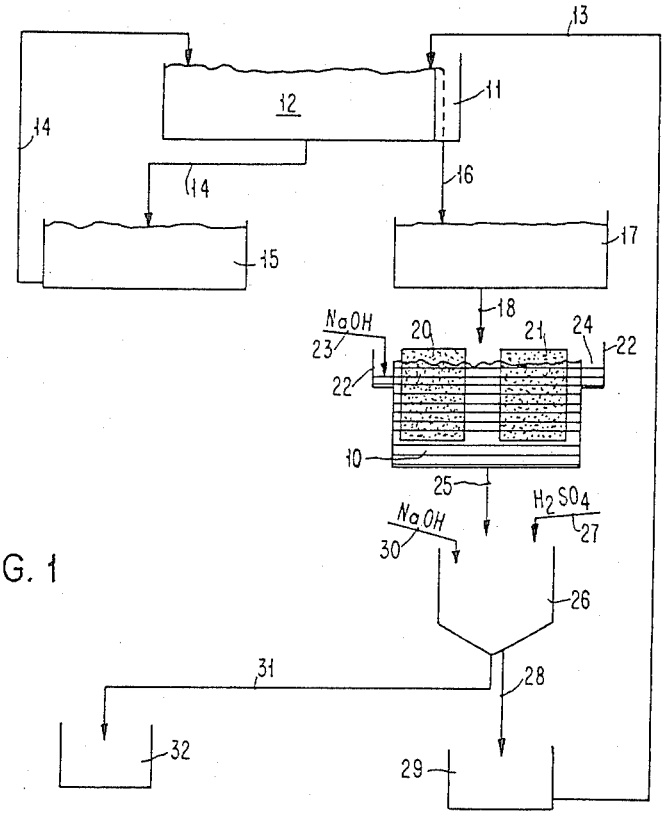
FIG. 1 shows a flow chart of the process according to the invention.

The process according to the present invention will now be generally described with reference to FIG. 1. The electroless copper plating bath 12 in tank 11 contains four basic constituents:

(1) copper ions in bivalent form;
(2) complexing agents for maintaining the copper in its bivalent form;
(3) alkali for buffering off excessive hydrogen ions and maintaining the pH value; and
(4) reducing agents, such as formaldehyde.

The bath may contain stabilizers, such as cyanide, and wetting agents as further additives.

For emptying copper plating tank 11 for cleaning purposes, a tank 15 with connecting lines 14 is provided. Pipeline 16 leads from copper plating tank 11 to collector tank 17. From collector tank 17, the copper plating bath to be regenerated is fed through feed line 18 to electrolytic unit 10 in which two electrode blocks 20 and 21 are arranged. Electrolytic unit 10 is provided with overflow tanks 22, in one of which pH measuring probe 24 is installed and to the other one of which, positioned on the opposite side, sodium hydroxide solution is added through line 23 for setting and maintaining the pH value. The circulation of the copper plating bath within the electrolytic unit will be described later with reference to FIG. 5. The number and the dimensions of the electrodes in each electrode block are determined on the basis of the current strength I, the current density i and the tank size. The electrodes are reciprocally arranged in such a manner that there is always one cathode between two anodes. The cathodes consist of thin copper foils, the anodes of stainless steel.

The demetallized bath solution is fed through pipeline 25 from the electrolytic unit to tank 26 in which the complexing agent is precipitated by lowering the pH value to an acidic level. To that end, an acid, such as sulphuric acid, hydrochloric acid, or the like, is added to tank 26 through line 27. The pH range suitable for precipitation is generally below 4.0 and for EDTA below 2.0, preferably below 1.0. In addition to ethylenediamine tetraacetic acid (EDTA), other complexing agents, suitable for electroless copper plating, such as potassium sodium tartrate (Rochelle salt), ethylinediamine tetraamine, triethanolamine, diethanolamine, and the like, may be processed.

The precipitated EDTA is washed twice in deionized water, the water used for washing being fed to tank 32 through pipeline 31. Subsequently, the EDTA may be dissolved once more as tetrasodium salt in sodium hydroxide solution and be cleaned by being reprecipitated with $H_2SO_4$. In tank 26, the cleaned ethylenediamine tetraacetic acid is dissolved in sodium hydroxide solution, added through line 30, to tetrasodium salt. On line 28, the EDTA-$Na_4$ (tetrasodium edetate) solution is fed to storage tank 29 from where it is transferred direct to chemical plating bath 12 via line 13, or a preliminary mixture with copper sulphate solution is prepared which is then also fed to chemical plating bath 12 in tank 11.

In a preferred embodiment, an electroless copper plating bath with the following constituents, ranges and parameters is used:

| | | |
|---|---|---|
| $CuSO_4 \times 5\ H_2O$ | g/l | 7.5–12 |
| EDTA | g/l | 35–60 |
| Gafac RE-610* | g/l | 0.25 ± 0.1 |
| NaCN | mg/l | 7–20 |
| formaldehyde (37 percent) | ml/l | 2–4.5 |
| pH (NaOH) | | 11.7 ± 0.1 |
| temperature | °C. | 73 ± 0.5 |

*trademark of General Aniline and Film Corporation.

The bath concentrations are set by adding separately prepared copper sulfate solution, formalin, sodium cyanide solution and sodium hydroxide solution when their concentration drops below a particular value.

The concentrations of the individual bath constituents are carefully controlled:

(1) that of $Cu^{++}$, for instance, by photometric measurement;

(2) that of formaldehyde by reaction with sodium sulfite, which changes the pH value;

(3) that of NaCN by means of an ion selective electrode; and (4) that of NaOH by means of a glass electrode.

The bath temperature, too, must be carefully controlled. The reaction products resulting from the electroless copper plating of activated surfaces of circuit boards are essentially $Na_2SO_4$ (sodium sulfate) and HCOONa (sodium formate) which reach a constant concentration during the use of the bath.

The copper plating bath is regenerated by initially reducing the copper content of the bath liquid by electrolysis to a concentration below about 20 mg/l and by subsequently precipitating the complexing agent by acidification. It has been found that the electrolysis used to reduce the copper content is crucial to the purity of the recovered ethylenediamine tetraacetic acid.

Figure 2:
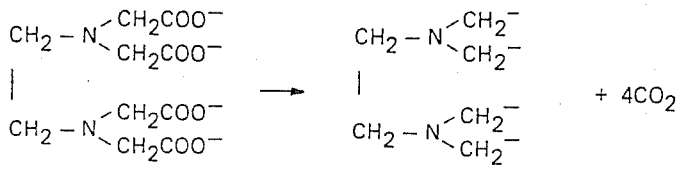
FIG. 2 shows the formulas of decomposition products, amines and further products.
Figure 2:
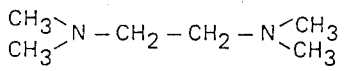
Figure 2:
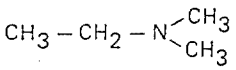
Figure 2:
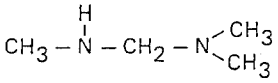
Figure 2:
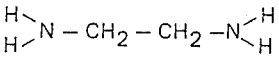
Figure 2:
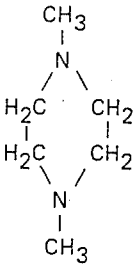
Figure 2:
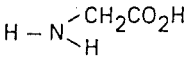
Figure 2:
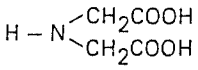

It has been found in actual fact that in electrolytic processes carried out using constant and relatively high anodic and cathodic current densities, the product obtained during the subsequent precipitation of the ethylenediamine tetraacetic acid is heavily contaminated by decomposition products and smells of amines. The decomposition products I, represented by the formulas in FIG. 2, and the amines II, formed by recombination of free radicals, were detected in numerous laboratory tests. In detail such products and amines were: tetramethylethylene diamine (a), dimethylethylamine (b), N-methyl-N'-dimethyl-diaminomethane (c), ethylenediamine (d), and cyclic amines (e). Further products III thus detected were glycine (f), iminodiacetic acid (g), and the like.

If amines, in particular ethylenediamine (d), are present in the copper plating bath, they adversely affect the grain structure of the deposited copper layer. The presence of amines leads to a coarse grained copper layer being deposited from the plating bath, in which cracks may occur when the layer is subsequently heated, for instance, during soldering. It is also known that amines may react with other bath constituents, for example, with formaldehyde, yielding s-triazine derivatives. S-triazine in turn, which stabilizes formaldehyde, also adversely affects the grain structure of the deposited copper layer.

By means of polarographic tests on samples of the copper plating bath it was determined that during electrolysis, carried out at constant current density, about 10% of the EDTA contained in the bath is decomposed. This is attributable to the fact that during electrolysis the anodes become heavily covered with oxygen, changing the potential and causing the potential threshold at which the EDTA is anodically decomposed to be exceeded. Therefore, the conditions for electrolysis must be chosen in such a manner that the EDTA is not decomposed.

When chemical copper plating baths are processed in the electrolytic cell, the simplest structure of which provides for copper cathodes to be arranged between stainless steel anodes, copper according the reaction equation $$[Cu^{2+}\ \text{EDTA complex}] + 2\ e^- \rightarrow Cu^{\pm 0} + \text{EDTA} \qquad (1)$$

is deposited on the copper cathodes by electroplating. As an undesirable, but unavoidable, side reaction, water is decomposed on the cathodes according to the following pattern:

$$\begin{array}{l} H_2O + e^- \rightarrow H + OH^- \\ H_2O + H + e^- \rightarrow H_2 + OH^- \\ \hline 2H_2O + 2e^- \rightarrow H_2\uparrow + 2OH^- \end{array} \quad (2)$$

In the strongly alkaline solution (pH value from 11 to 12), molecular oxygen is formed on the anode by removing the electrons:

$$4\ OH^- \rightarrow O_2 + 2H_2O + 4\ e^- \quad (3)$$

This consumption of OH ions during the electrolysis leads to a drop of the pH value. At an initial pH value of, say, 11.7, a final pH value of 9.4 is obtained after an electrolysis time of about 10 hours. Since the proportion of decomposition products increases as the pH value declines, the electrolytic unit is provided with control means (23 and 24 in FIG. 1) which keep the pH value constant during electrolysis.

Figure 3:
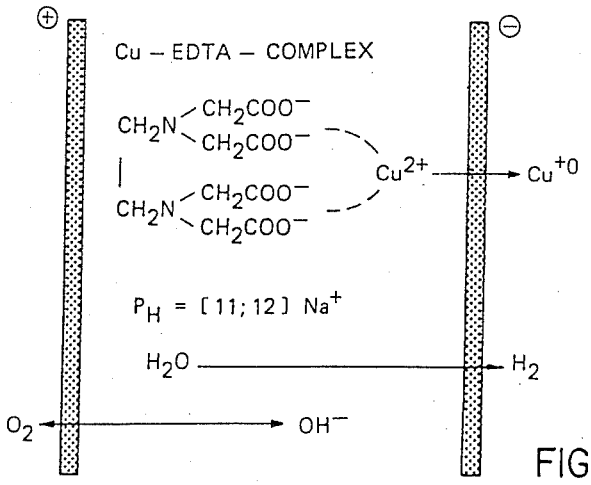
FIG. 3 shows the reactions occurring between anode and cathode.

The reactions at the cathode and anode are shown highly simplified in FIG. 3. As copper is electrodeposited on the cathodes, the copper ions of the electrolyte become impoverished until electrolysis is discontinued at a residual Cu content of about 20 mg/l. In practice, the copper content of the electrolyte is continuously measured during electrolysis. After the desired end value has been reached, the system switches off automatically.

For the above-described chemical reactions at the cathode and anode, the following electrochemical relations a–d apply:

(a) The cathodic deposition of copper impoverishes the copper ions of the electrolyte. Therefore, the potential depends on the copper ion concentration which is given by $$\epsilon_{cathode} = E_o + \frac{RT}{n_e \cdot F} \Sigma \nu_i \ln c[Cu^{2+}]$$

where $\Sigma \nu_i$ is the sum of all factors influencing the potential.

(b) The current density i also depends on the concentration, with the limiting current density being determined by the copper ion concentration and the temperature $$i_{lim} = f([Cu^{2+}];\ t).$$

It is only after a sizeable amount of copper has been deposited during electrolysis that the dependence of the potential and the current density on the copper ion concentration becomes significant. In such a case, the values of the limiting potential and the limiting current density obtained may be such that the EDTA is decomposed.

As the electrodes become covered with hydrogen and oxygen, respectively, during electrolysis, they are turned into gas electrodes, the electromotive force of which inhibits the copper deposition process:

$$\epsilon_{cathode} = E_o - \frac{RT}{2F} \cdot \ln p_{H2} \text{ and}$$

$$\epsilon_{anode} = E_o - \frac{RT}{2F} \cdot \ln p_{O2}$$

The principal reaction $$[Cu^{2+}\ \text{EDTA complex}] + 2e^-\ Cu^{+0} + \text{EDTA}$$

counteracted by the electromotive force EMK which is a function of $p_{H2}$ and $p_{O2}$.

Figure 4:
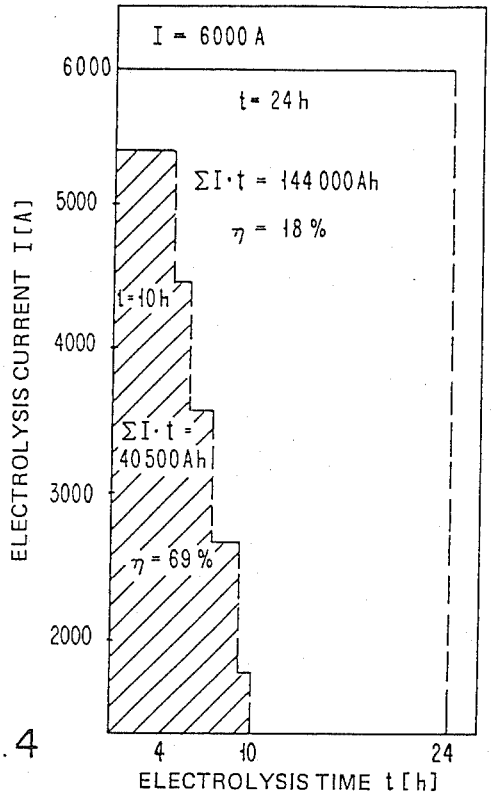
FIG. 4 shows current values of the electrolysis as a function of the electrolysis time.

During electrolysis carried out at constant, relatively high current densities, the proportion of hydrogen and oxygen, which increases as electrolysis proceeds, leads to a large drop in the current and energy yield relative to the copper to be deposited. As a result, a very long electrolysis time is needed to reach the desired residual copper content of about 20 mg/l. If, for example, 15 $m^3$ additive bath with a content of 8 g/l $CuSO_4 \times 5\ H_2O$ ($\hat{=}$2.03 g/l Cu) is subjected to electrolysis at a constant current strength of 6000 Ampere and a current density of about 100 $A/m^2$, the mean cathodic current yield in 24 hours $\overline{\eta}_{(Cu,\ 24h)}$ is only 18%. The by far larger proportion, i.e. the residual 82%, of the energy required is used for water decomposition and side reactions. The mean cathodic current yield calculated for the first 10 hours is 69% as referred to the copper to be deposited. After another 14 hours, i.e., after a total period of 24 hours, the mean cathodic current yield is only 18%. The right-hand side of FIG. 4 shows the electrolysis current I versus the electrolysis time t for this embodiment. An electrolysis time t of 24 hours is necessary to reach the desired copper content of the solution of <20 mg/l. In 24 hours, a mean cathodic current yield of only 18% is obtained, as previously mentioned.

These results necessitate that the development of hydrogen and oxygen during electrolysis be minimized and that any gasses formed be removed from the electrodes as quickly as possible to improve the cathodic current yield relative to the copper to be deposited and to reduce the electrolysis time for lowering the desired copper content to 20 mg/l. A reduction in the electrolysis time also leads to a reduction in the number of byproducts occurring.

The gas is best removed from the electrodes by using for the electrolysis a high internal bath circulation rate at which the electrolyte is circulated at about 10 to 50 volumes per hour. In the preceding embodiment with a content of the electrolysis cell of 15 $m^3$, 300 $m^3$ of electrolyte have to be circulated per hour at an electrolyte movement of 20 volumes per hour.

Figure 5:
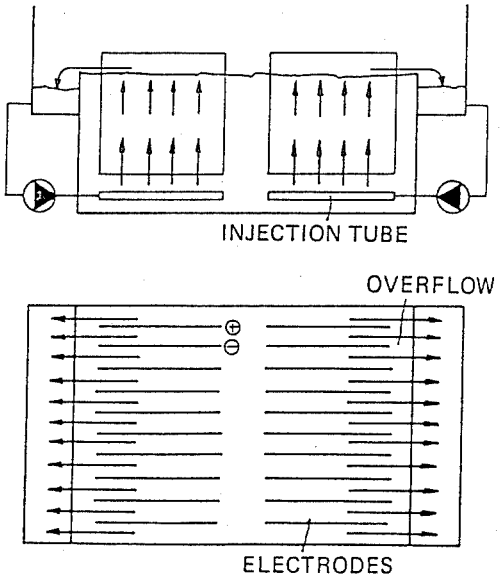
FIG. 5 shows the electrolysis cell with two overflow tanks for the internal circulation of the electrolyte.

FIG. 5 shows an apparatus in which the electrolyte is circulated by means of injection tubes positioned below the electrodes. The electrolyte is fed from the electrolysis cell to overflow tanks arranged on either side of the electrolytic unit, from where it is fed back to the injection tubes. The upper portion of FIG. 5 shows a lateral view of an electrolytic unit comprising of an electrolysis cell and two overflow tanks and injection tubes below the electrodes. The lower portion of FIG. 4 shows the same apparatus viewed from the top. Space permitting, it is advantageous to have a buffer tank (not shown) adjacent to the electrolytic unit, into which the electrolyte is fed from the overflow tanks from where it is fed back to the electrodes through the injection tubes.

In addition to the electrolyte movement, the current density decisively influences the process according to the present invention. For most electrolytic processes for recovering or electrorefining copper, wherein a constant current density is generally used for the entire electrolysis, economic criteria determine the most favorable current density. The present invention, rather than offering an inexpensive means for recovering copper, is aimed at providing means for the inexpensive recovery of a substantially pure ethylenediamine tetraacetic acid that can be fed back to the electroless copper plating bath for the production of circuit boards. In conventional electrolytic processes for the recovery of copper, the anodic and the cathodic current densities for copper electrolytes of comparable concentration are about 200 $A/m^2$ and in exceptional cases 300 $A/m^2$. These relatively high current densities cannot be used for the present invention, as at them there is an electrochemical decomposition of the ethylenediamine tetraacetic acid. Tests have shown that for recovering a pure ethylenediamine tetraacetic acid, a maximum anodic current density $i_+ = 100$ $A/m^2$ must not be exceeded in the inventive process.

An electrolytic system for the process according to the invention is designed for a maximum current strength $I_{max}$ of, for example, 6000A, but will be operated at a current strength not exceeding about 5400A. The system has 36 copper cathodes with an active total area $\Sigma f$ of 77.1 $m^2$ and 38 stainless steel anodes with an active total area $\Sigma f$ of 88.9 $m^2$. In that case, the maximum current densities are $i_{-max} = 70$ $A/m^2$ and $i_{+max} = 60.7$ $A/m^2$, where the anodic current density is $\leqq$ the cathode current density, so that when the anode becomes covered with oxygen, which is not totally unavoidable, the potential threshold at which the EDTA starts to decompose is not exceeded. These numerical values show that the electrolytic system is operated at only around 60% of the maximum permissible anodic current densities. This further reduces the risk of detrimental decomposition products of the ethylenediamine tetraacetic acid being formed during anodic oxidation. For avoiding the formation of detrimental decomposition products altogether, it is most advantageous to work not only with constant current densities but also with current densities that may be reduced continuously or in steps according to the electrolysis characteristic as electrolysis proceeds (left-hand side of FIG. 4).

Table 1 shows in column 1 the electrolysis time divided into hours and in column 2 the drop of the mean cathodic current yield $\overline{\eta}_-$ in percent as a function of the electrolysis time (column 1). The relevant tests were carried out at a constant anodic current density $i_+$ of 100 $A/m^2$. Column 3 shows the reduction of the anodic current density $i_+$ in $A/m^2$, as proposed for the present invention, and column 4 the relevant current strength I in Ampere. Column 5 shows the mean cathodic current yield $\overline{\eta}_-$ for the anodic current densities indicated in column 3. There is a noticeable improvement over the values of column 2 (constant anodic current density).

TABLE 1

| Electrolysis Time t(h) | Mean Cathodic Current Yield $\overline{n}_-$ in Percent | Proposed Reduction of Anodic Current Density $i_+$ in $A/m^2$ | Current Strength I to be Set in Amp. | Relevant Mean Cathodic Current Yield $\overline{n}_-$ in Percent |
|---|---|---|---|---|
| 4 | 82 | 60 | 5400 | 82 |
| 5 | 37 | 50 | 4500 | 51 |
| 6 | 27 | 40 | 3600 | 39 |
| 7 | 20 | 40 | 3600 | 35 |
| 8 | 14 | 30 | 2700 | 33 |
| 9 | 8 | 30 | 2700 | 23 |
| 10 | 5 | 20 | 1800 | 21 |
| 11 | <1 | electrolysis is discontinued | — | — |

constant anodic current density $i_+ = 100$ $A/m^2$

The table shows that in the first four hours at a constant anodic current density $i_+$ of 100 $A/m^2$ the mean cathodic current density $\overline{\eta}_-$ is about 80%. Between the fourth and the fifth hour, the current yield at the same current density drops to about 37%. After about 12 hours, the mean cathodic current yield has dropped to a value below 1%, i.e., almost the entire electric energy is no longer employed for the deposition copper but for the decomposition of water and for undesired side reactions. Based on the table, a mean cathodic current yield $\overline{\eta}_-$ of 44% is obtained calculated over a period of 10 hours at a constant anodic current density $i_+ = 100$ $A/m^2$.

The mean cathodic current yield substantially improves if the anodic current density is reduced (column 3) as the electrolysis time increases. According to table 1, this requires a total electric energy of $$\Sigma Q = \Sigma I \cdot t = 40500\ A/h.$$

This corresponds to a current yield $\eta = 69\%$ calculated over a period of ten hours, with calculation being based on a mean copper content of 2.2 g/l. The electrolysis time can be calculated from the test data in table I according to Faraday's law on the basis of the subsequent initial values

| | |
|---|---|
| electrolyte volume | $V = 15\ m^3$ |
| copper content of additive bath | $m = 2.2\ g/l$ |
| mean current strength | $\bar{I} = 4050\ A$ |
| mean cathodic current yield | $\overline{n}_- = 69\%$ |

The time t thus calculated is 10 hours.

According to these calculations it can be assumed that when the current densities are reduced during electrolysis, the latter may be discontinued after ten to twelve hours, which compared with the constant anodic current density electrolysis previously used to recover copper means a 50 percent reduction of the electrolysis time. As a result of the shorter electrolysis time there are fewer EDTA decomposition products.

Figure 6A:
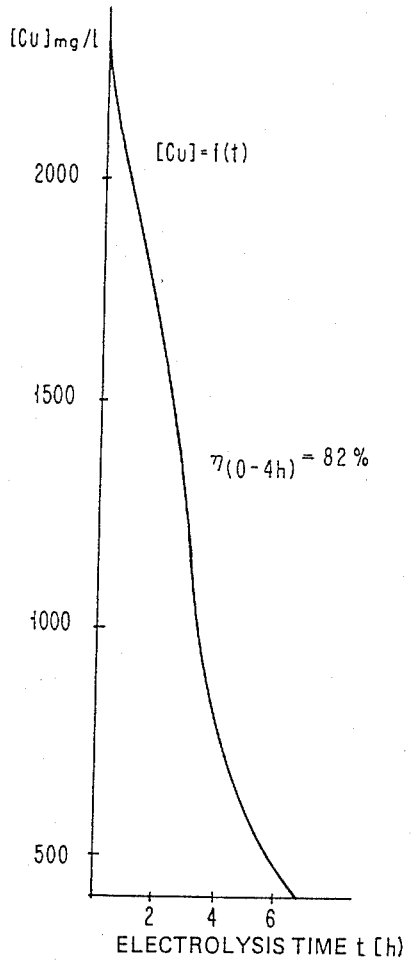
FIGS. 6A and 6B show the copper content of the copper plating bath in mg/l as a function of the electrolysis time in hours.
Figure 6B:
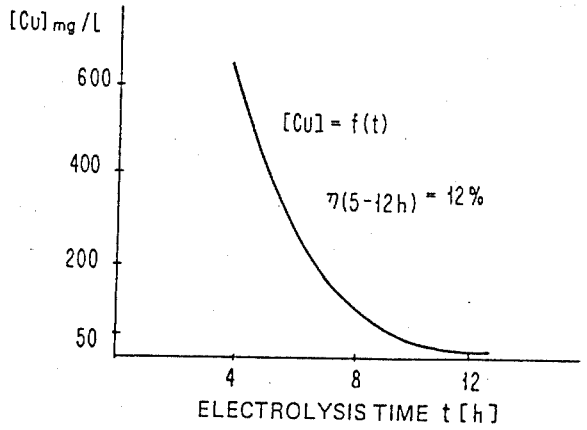

FIG. 6A shows the drop of the copper content of the copper plating bath during the first four hours of electrolysis. FIG. 6B shows the drop of the copper content of the bath between the fifth and the twelvth hour of electrolysis, in each case at a constant anodic current density $i_+$ of 100 $A/m^2$. If the anodic current density is reduced during electrolysis, the mean cathodic current yield is improved and the electrolysis time is reduced even further.

While the invention has been described with respect to a preferred embodiment thereof, it will be understood by those skilled in the art that various changes in detail may be made therein without departing from the spirit, scope, and teaching of the invention. Accordingly, the invention herein described is to be limited only as specified in the following claims.

What is claimed is:

1. A process for regenerating a complexing agent in an electroless copper plating bath, comprising the steps of:

withdrawing the bath solution containing the complexing agent from the electroless plating bath;

reducing the copper content in the withdrawn bath solution to a value below 20 mg/l by electrolysis, the anodic current density $i_+$ not exceeding 100 $A/m^2$;

acidifying the bath solution thus obtained by precipitating the complexing agent and recovering same;

dissolving the recovered complexing agent in an alkaline electrolyte solution; and returning the solution to the electroless copper plating bath.

2. A process for regenerating a complexing agent in an electroless copper plating bath, comprising the steps of:

withdrawing the bath solution containing the complexing agent from the electroless plating bath;

reducing the copper content in the withdrawn bath solution by electrolysis, the anodic current density $i_+$ not exceeding 100 $A/m^2$ the bath circulation rate being approximately 10 to 50 volumes/h;

acidifying the bath solution thus obtained by precipitating the complexing agent and recovering same;

dissolving the recovered complexing agent in an alkaline electrolyte solution; and returning the solution to the electroless copper plating bath.

3. A process for regenerating a complexing agent in an electroless copper plating bath, comprising the steps of:

withdrawing the bath solution containing the complexing agent from the electroless plating bath;

reducing the copper content in the withdrawn bath solution by electrolysis the anodic current density $i_+$ not exceeding 100 $A/m^2$, the pH value of the withdrawn bath being maintained constant during electrolysis;

acidifying the bath solution thus obtained by precipitating the complexing agent and recovering same;

dissolving the recovered complexing agent in an alkaline electrolyte solution; and returning the solution to the electroless copper plating bath.

4. A process for regenerating a complexing agent in an electroless copper plating bath, comprising the steps of:

withdrawing the bath solution containing the complexing agent from the electroless plating bath;

reducing the copper content in the withdrawn bath solution by electrolysis, the anodic current density $i_+$ not exceeding 100 $A/m^2$;

acidifying the bath solution thus obtained by precipitating the complexing agent and recovering same;

dissolving the recovered complexing agent in an alkaline electrolyte solution; and returning the solution to the electroless copper plating bath.

5. A process for regenerating a complexing agent in an electroless copper plating bath, comprising the steps of:

withdrawing the bath solution containing the complexing agent from the electroless plating bath;

reducing the copper content in the withdrawn bath solution by electrolysis, the anodic current density $i_+$ not exceeding 100$A/m^2$ the anodic current density being reduced during electrolysis as the electrolysis characteristic drops;

acidifying the bath solution thus obtained by precipitating the complexing agent and recovering same;

dissolving the recovered complexing agent in an alkaline electrolyte solution; and returning the solution to the electroless copper plating bath.

6. A process for regenerating a complexing agent in an electroless copper plating bath, comprising the steps of:

withdrawing the bath solution containing the complexing agent from the electroless plating bath;

reducing the copper content in the withdrawn bath solution by electrolysis, the anodic current density $i_+$ not exceeding 100 $A/m^2$ the anodic current density being reduced during electrolysis in steps;

acidifying the bath solution thus obtained by precipitating the complexing agent and recovering same;

dissolving the recovered complexing agent in an alkaline electrolyte solution; and returning the solution to the electroless copper plating bath.

7. The process according to claim 2 wherein the bath circulation rate is approximately 20 volumes/h.

8. The process according to claims 1, 2, 3, 4, 5, or 6 wherein the complexing agent comprises potassium sodium tartrate, ethylenediamine tetraamine, triethanolamine or diethanolamine.

9. The process according to claims 1, 2, 3, 4, 5, or 6 wherein the complexing agent comprises ethylenediamine tetraacetic acid.

10. The process according to claim 9 wherein the ethylenediamine tetraacetic acid is precipitated by acidification of the bath solution to a pH value below 2.0 after removal of the copper ions.

11. The process according to claim 10 wherein the precipitated ethylenediamine tetraacetic acid is purified by being dissolved in sodium hydroxide solution and by being reprecipitated with $H_2SO_4$.

12. The process according to claim 11 wherein the purified ethylenediamine tetraacetic acid is dissolved in sodium hydroxide solution and fed directly to the chemical copper plating bath.

13. The process according to claim 12 wherein a preliminary mixture of the purified ethylenediamine tetraacetic acid is prepared with a copper sulfate solution and fed to the copper plating bath to replenish both the ethylenediamine tetraacetic acid and the copper.

14. A process for regenerating a complexing agent in an electroless copper plating bath, comprising the steps of:

withdrawing the bath solution containing the complexing agent from the electroless plating bath;

reducing the copper content in the withdrawn bath solution to a value below 20 mg/l by electrolysis, the bath circulation rate being approximataely 10 to 50 volumes/h, the pH value of the withdrawn bath being maintained constant during electrolysis, the anodic current density $i_+$ not exceeding 100

A/m, the anodic current density being reduced during electrolysis according to the electrolysis characteristic;

acidifying the bath solution thus obtained by precipitating the complexing agent and recovering same;

dissolving the recovered complexing agent in an alkaline electrolyte solution; and returning the solution to the electroless copper plating bath.

15. A process for regenerating a complexing agent in an electroless copper plating bath, comprising the steps of:

withdrawing the bath solution containing the complexing agent from the electroless plating bath;

reducing the copper content in the withdrawn bath solution to a value below 20 mg/l by electrolysis, the bath circulation rate being approximately 10 to 50 volumes/h, the pH value of the withdrawn bath being maintained constant during electrolysis, the anodic current density $i_+$ not exceeding 100 $A/m^2$, the anodic current density being reduced during electolysis in steps;

acidifying the bath solution thus obtained by precipitating the complexing agent and recovering same;

dissolving the recovered complexing agent in an alkaline electrolyte solution; and returning the solution to the electroless copper plating bath.

* * * * *